United States Patent [19]

Tsujimoto et al.

[11] 4,256,127

[45] Mar. 17, 1981

[54] HAIR WAVING APPLIANCE WITH INFRARED HEATERS AND AN ULTRASONIC ATOMIZER

[75] Inventors: Susumu Tsujimoto, Fujiidera; Hayao Yamazaki, Ikoma; Masayoshi Ozaki, Kawachinagano; Takehiro Kobayashi, Sakai, all of Japan

[73] Assignee: Sharp Kabushiki Kaisha, Osaka, Japan

[21] Appl. No.: 862,964

[22] Filed: Dec. 21, 1977

[30] Foreign Application Priority Data

Dec. 27, 1976 [JP] Japan ..... 51-158479

[51] Int. Cl.[3] ..... A45D 20/20; A45D 20/38; H05B 3/02; A45D 20/22

[52] U.S. Cl. ..... 132/9; 219/486; 219/483; 132/7; 34/98

[58] Field of Search ..... 34/26, 98, 993, 96, 34/97, 91; 219/240–241, 251, 499, 486, 222; 132/33 R, 97, 112, 9, 122, 7; 361/92; 128/DIG. 2, 893, 173 R; 401/121

[56] References Cited

U.S. PATENT DOCUMENTS

| | | | |
|---|---|---|---|
| 3,281,948 | 11/1966 | Goble | 132/9 |
| 3,289,679 | 12/1966 | Zellerman | 132/9 |
| 3,464,425 | 9/1969 | Gagliano | 132/9 |
| 3,550,285 | 12/1970 | Omohundro | 132/9 |
| 3,575,181 | 4/1971 | Rudd | 132/9 |
| 3,821,516 | 6/1974 | Hayes et al. | 219/499 |
| 3,903,904 | 9/1975 | Hemrich et al. | 132/9 |
| 3,905,355 | 9/1975 | Brudny | 128/2.1 A |
| 3,934,596 | 1/1976 | Suntheimer et al. | 132/9 |
| 4,001,650 | 1/1977 | Romain | 128/DIG. 2 |
| 4,011,430 | 3/1977 | Witkin et al. | 219/486 |
| 4,027,204 | 5/1977 | Norbeck | 361/92 |
| 4,040,117 | 8/1977 | Houser | 361/92 |
| 4,124,034 | 11/1978 | Meyerhoefer et al. | 132/33 R |

*Primary Examiner*—Gene Mancene
*Assistant Examiner*—Michael J. Foycik, Jr.
*Attorney, Agent, or Firm*—Birch, Stewart, Kolasch & Birch

[57] ABSTRACT

A hair waving appliance of the type having a hood assembly includes a plurality of independently controllable heating means such as infrared heaters or lamps valves each disposed to heat a different hairline area of the head of a patron. A temperature control and a timer are provided for individual ones of the heating elements for controlling a temperature and a period of heating independently of one another. In addition, an ultrasonic atomizer is provided within the head supporting assembly to generate moisture-laden air mist, imparting longer-lasting curl retention. A heating temperature or a period of heating can be determined under the control of at least either the temperature control or the timer depending upon the hair nature of the hairline areas and personal taste of the patron.

37 Claims, 8 Drawing Figures

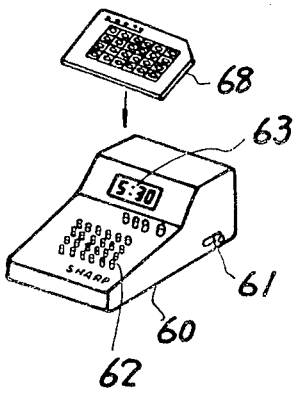
FIG.3
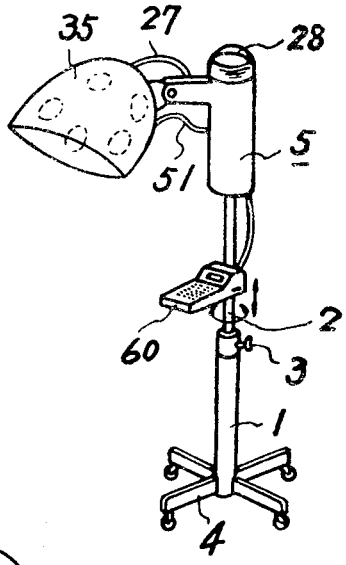
FIG.1
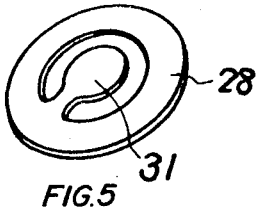
FIG.5
| name | | partial control (min.) | | | | | temp. |
|---|---|---|---|---|---|---|---|
| | | a | b | c | d | e | |
| address | | 0 m. | 0 m. | 0 m. | 0 m. | 0 m. | 40°C |
| birthday | | | | | | | |
| room temp. | | 5 m. | 5 m. | 5 m. | 5 m. | 5 m. | 45°C |
| agent | | 10 m. | 10 m. | 10 m. | 10 m. | 10 m. | 50°C |
| root size | | | | | | | |
| hair nature | | 15 m. | 15 m. | 15 m. | 15 m. | 15 m. | 55°C |
| hair style | | 20 m. | 20 m. | 20 m. | 20 m. | 20 m. | 60°C |
| remark | | | | | | | |
68 69 69 69
FIG.4

HAIR WAVING APPLIANCE WITH INFRARED HEATERS AND AN ULTRASONIC ATOMIZER

BACKGROUND OF THE INVENTION

The present invention relates to a heating and moisturizing type hair waving appliance.

A conventional way to confer a durable hair wave is to allow a waving agent to react on hair at room temperature. This is called "cold waving". However, in this instance the waving agent, for example, thioglycolate should be strong because it reacts on hair at room temperature. There is a great risk that the waving agent will damage the skin of a beautician and the hair of a patron. In addition, since the period where the waving agent reacts on the hair is determined primarily by feelings and experiences of a beautician, the degree of hair waving will occasionally be too great or not sufficient.

Lately, some approaches to overcome the defects noted above have been suggested, that is, heating types of a hair waving appliance wherein hair is heated before the reaction of a waving agent. One method of waving hair involves curling the hair about heat-accumulated curler rods to heat the hair and allowing a waving agent to react on the hair. An alternative method of waving hair involves supplying hot air to waving agent laden hair to heat the same during the reaction of the waving agent. See, for example, German Pat. Nos. 1059160 issued on Apr. 26, 1962 and No. 1079801 issued on Sept. 13, 1962.

Both methods were effective to weaken the intensity of the waving agent. However, the former suffered difficulties in maintaining the reaction of the waving agent at the optimum temperature and adjusting the reaction period because the temperature of the curler rods falls quickly, while in the latter method there is likehood of drying the waving agent out by hot air prior to the reaction of the waving agent. In addition, as disclosed in the last-named patent, a steam generator has been proposed for moisturization purposes thereby to relax the hair molecular structure. The interior of the head supporting assembly would be, therefore, heated up to the vapor temperature, viz., 100° C. by provision of the steam generator.

SUMMARY OF THE INVENTION

Accordingly, the present invention overcomes all the disadvantages noted with the above outlined prior art by providing an improved hair waving appliance.

Pursuant to the present invention, a hair waving appliance comprising a hood assembly, a plurality of heating means disposed within said hood assembly to heat different hairline areas of the head of a parton, temperature control means for controlling the heating temperature by said heating means, timer means for controlling a period of time said heating means is activated, and atomizer means for generating mist within said hood assembly at room temperature. A heating temperature or a period of heating can be determined optionally under the control of at least either the temperature control means or the timer means. A temperature control and a timer can be provided for individual ones of said plurality of the heating means. In one aspect of the present invention, the atomizer is of the ultrasonic type which shoots out a fine spray of water or the like at room temperature to impart moisture to all the hairline areas of the head of the patron.

One of important features of the present invention resides in the fact that a waving agent is allowed to react on the hair under the heated condition thereof with adequately controllable temperature and duration of the reaction and the hair is imparted with moisture by a moisture-laden air mist mixture dissipated at room temperature by the ultrasonic atomizer. This makes it possible to use weak waving agents and ensure a desired degree of hair curling or waving. Moreover, this prevents waving agents from drying out prior to the reaction on the hair.

Since the moisture-laden air mist is dissipated at room temperature (water temperature), the temperature within the hood assembly can reach the predetermined temperature determined by the heating means so that the degree of hair waving is neither too much nor too little and dependent primarily upon the type and quantity of waving agents and heating temperatures. In other words, the period involved in heating can differ considerably because of differences in the hair itself as well as the hair style desired. This results in satisfactory curling and waving. In addition, the temperature within the hood assembly is kept at room temperature during heating action so that different hairline areas can be heated independently of one another, thus adequately adjusting the degree of waving for different hairline areas.

In contradistinction thereto, the temperature of the vapor generated from the steam generator as taught by the above referenced German Patent rises above about 100° C. and the temperature of the atmosphere within the hood assembly is not adequately controllable and is non-uniform. In the device disclosed by the German Patent it is difficult to provide a partial control for the temperature at different hairline areas.

In another aspect of the present invention, a controller for controlling a heating period and a heating temperature is responsive to inputs indicative of the hair nature of the patron and the hair style desired. A predetermined number of patron's cards for entry of name, address, hair natures, etc., can be used with the hair waving appliance of the present invention.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A better understanding of the present invention may be had from a consideration of the following detailed description taken in conjunction with the accompanying drawings in which:

FIG. 1 is a perspective view of one preferred form of the present invention;

FIG. 3 is an enlarged perspective view of a controller in the preferred form shown in FIG. 1;

FIG. 4 is an example of a patron card used with the preferred form shown in FIG. 1;

FIG. 5 is a perspective view of a packing ring used in the preferred form shown in FIG. 1;

DETAILED DESCRIPTION OF THE INVENTION

Figure 2:
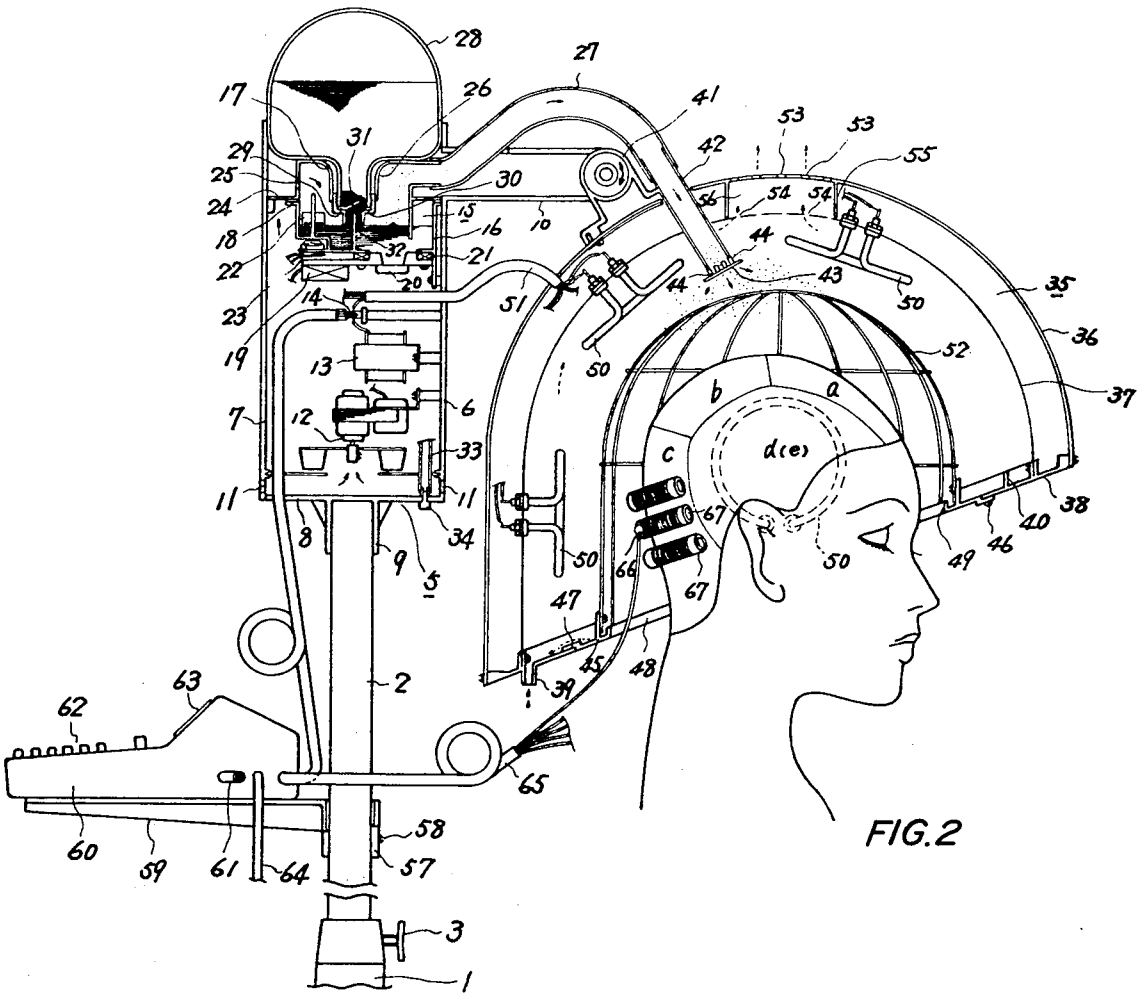
FIG. 2 is a cross-sectional side view of the preferred form shown in FIG. 1.

Referring now to the drawings in which like parts are designated by like numerals in the various views, there is shown in FIGS. 1 and 2 a hair waving appliance which includes a standing prop 1 through which the position of a slidable tube 2 is adjustable by means of a screw 3. The standing prop 1 rests on a pedestal 4. An appliance body 5 is tightly secured about the upper end of the prop 1, which comprises a pair of semicylindrical housings 6, 7 jointed via screws and a bottom plate 8 integral with one of the two housings 6. The bottom plate 8 is provided at the rear side with a cylindrical bracket 9 for retaining the appliance body 5 on the upper end of the prop 1. The one of the two housings 6 further has a transversely extending arm 10.

The two housings 6, 7 may be fabricated by a well known method such as die cast.

The body 5 has a predetermined number of perforations 11 about the periphery thereof and contains a blower 12, a power transformer 13, a connection terminal, and an ultrasonic atomizer assembly 15 therein. These components are all secured on the one of the two housings 6. The ultrasonic atomizer assembly 15 comprises a water reservoir 16, a lid 17, a packing ring 18, an ultrasonic oscillator circuit 19, an ultrasonic transducer 20, a packing member 21, a float 22, a lead switch 28 and so on, thereby dissipating moisture-laden air mist mixture under the normal temperature condition (room temperature). The periphery of the lid 17 is placed in close proximity with the inner wall of the body 5 except for a cutout 24.

By the action of the blower 12 air attracted via the perforations 11 cools the transformer 13, the ultrasonic atomizer 15, etc., while passing therethrough, and then reaches the cutout 24 in the lid 17. Air passing the cutout 24 is led via another cutout 24 in the lid 17 into the water reservoir 16 by a replenish tank discussed below, and then entered into a cylindrical guide 26 formed in the lid 17 together with the moisture-laden air mist.

The cylindrical guide 26 is coupled with one end of a connection hose 27 of which the other end extends outwardly through the supporting arm 10.

The replenish tank 28 includes a water supply opening 30 via a packing member 29 and is mounted with the supply opening 30 down. Under these conditions the supply opening 30 is opened for water supply to the water reservoir 16. As is obvious from FIG. 5 the packing member 29 is formed integral with a water supply valve 31. When the replenish tank 28 is mounted above the lid 17, a pin 32 standing on the bottom of the water reservoir 16 urges the valve 31 upwardly to the opened position. In the absence of water within the replenish tank 28 and within the water reservoir 16, the magnet-loaded float drops so that magnet turns the lead switch 23 off. Therefore, the ultrasonic oscillator circuit 19 is opened to protect the transducer 20, etc. The periphery of the replenish tank 28 mates with the lid 17 and is kept in close proximity with the inner wall of the body 5. Thus, air is directed upwardly via the cutout 24 into the water reservoir 16 through the second cutout 25 without any leakage. A drain hose 33 is provided to discharge water within the water reservoir and has a sealing cap 34 by the lower end.

A hood helmet 35 is made with a double walled construction which contains an outer shell 36 generally hemispherical in shape and made of plastic material and an inner shell 37 generally hemispherical in shape and made of a metallic material. The outer shell 36 and the inner shell 37 are supported in a spaced relationship on a common hollow disc 38. The inner periphery of the supporting disc 38 extends inwardly toward the center of the inner shell 37. The supporting disc 38 is provided with a drain outlet 39 and a drain leading rib 40 of a semicircular shape, the drain outlet 39 and the drain leading rib 40 are positioned within a cavity defined by the inner shell 37 and the outer shell 36.

The outer shell 36 is secured via a holder 41 for rotation about the end of the supporting arm. An angle of elevation of the hood assembly 35 is, therefore, adjustable with respect to the supporting arm 10. The holder 41 is integral with a mist conduit 42 connected to the hose 27. The mist conduit 42 is exposed to the inside of the hood helmet 35 via the outer shell 36 and the inner shell 37. An obstacle 43 is provided at the end portion of the conduit 42 to distribute uniformly the moisture-laden air mist from a nozzle 44 throughout the inside of the helmet 35.

A second and inner disc 45 with an opening 48 for insertion of the hairline area of the head of a patron or user, is removably disposed inside the supporting disc 38 by a combination of a screw 46 and an integral ear 47. The inner disc 45 is provided at the inner periphery with a rising wall 49 which prevents drain water from dropping from the opening 48.

A predetermined number of heater elements 50 are disposed within the cavity between the inner shell 37 and the outer shell 36. In the case where the hairline area is divided into five areas a through e, these five heater elements 50 are provided for individual sections of the hairline areas. The individual heater elements 50 heat the different hairline areas. The heater elements 50 may be infrared heaters for example. The electrical connectoins of the heater elements 50 to the associated leading wires 51 are provided between the outer shell 36 and the inner shell 37. Thus, these connections are isolated from the high-humidity atmosphere within the inner shell 37. A protector net 52 is hemispherical in shape and is provided to keep the hair away from the heater elements 50.

The top of the outer shell 36 is provided with air outlets 53 for the discharge of used air while the top of the inner shell 37 is provided with air perforations 54. The air perforations 54 are communicated with the air outlets 53 via a path 56 defined by a partition 55.

A position adjustable stopper 57 is fastened on the tube 2, which retains a rotatable table 59 at a desired height. A controller 60 rests on the table 59, which comprises a power switch 61, push botton switches 62, a time display 63, utility cords 64, and a sensor cable 65. The sensor cable 65 contains a predetermined number of thermo-sensitive elements 66, for example, negative characteristic thermistors. The number of the thermistors 66 corresponds to the number of the heater elements 50. The thermistors 66 are attached to the hair through the use of curler rods 67 which are available when the hair is curled.

As seen from FIGS. 3 and 4, a patron's card 68 for entry of given items has punch holes 69 in positions to correspond to the push botton switches 62 in the controller 60, the respective punch holes 69 being given corresponding heating periods and heating temperatures. The heating periods are established for the individual ones of the hairline areas a through e, while the heating temperatures are established in common for all the hairline areas. Therefore, the heating temperatures and the heating periods for the individual hairline areas a through e are selected depending upon differences in the patron's hair and the hair style desired, marking the desired punch holes 69. When introducing input into the controller 60, the push button switches are correspondingly operated in accordance with the registration on the patron's card 68.

Figure 6:
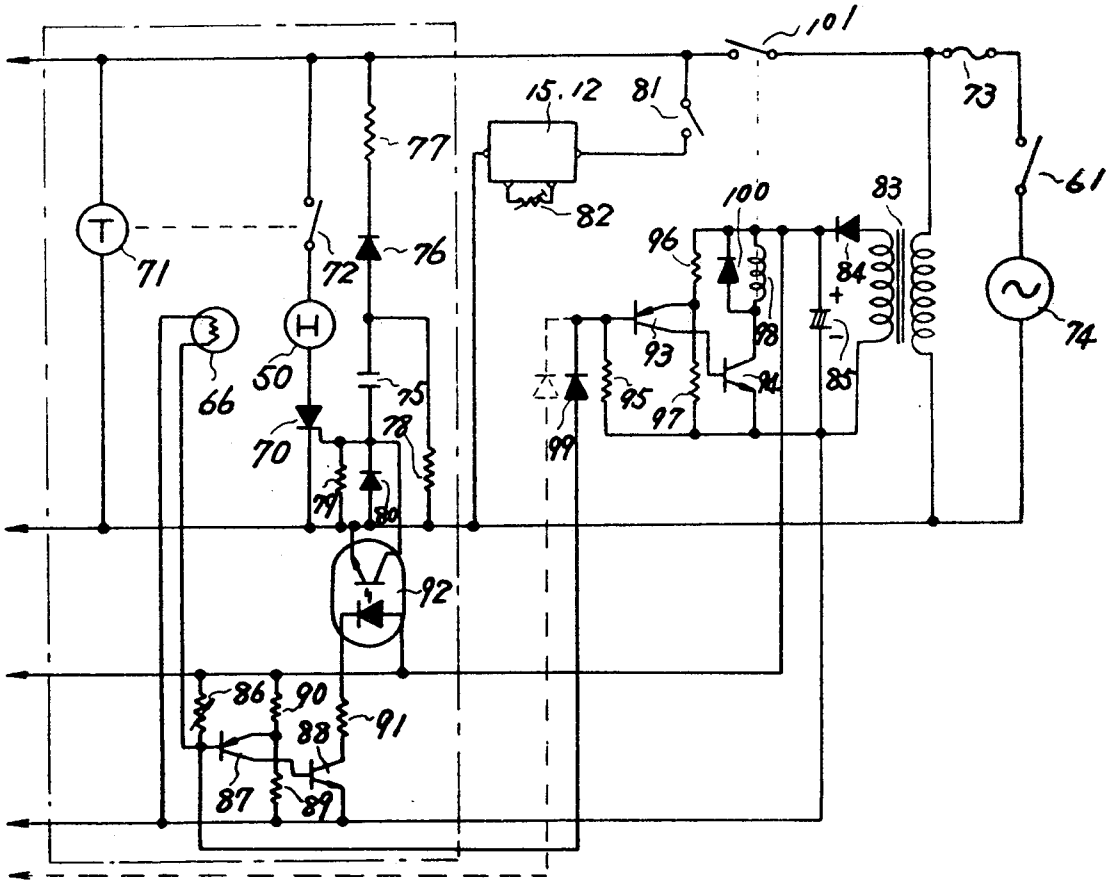
FIG. 6 is a diagram of a circuit configuration within the controller shown in FIG. 3.

FIG. 6 illustrates a circuit configuration contained within the controller 60. Although the controller 60 is shown for illustrative purposes as having only one control circuit for controlling the one heater element 50 inclusive of the one temperature control and the one timer, as defined by the dotted line, the actual number of the control circuits are typically five in the above given example. These control circuits are connected in parallel with one another.

The heater element 50 is connected in series with a thyrister 70 and a timer contact 72, that series circuit being connected in parallel with a timer motor 71. This parallel circuit is connected across an a.c. power supply 74 via a series circuit of a temperature fuse 73 and the above discussed power switch 61. The timer motor 71 and the timer contact 72 form timer means available for setting the heating periods of the heater element 50. Needless to say, the timer means are provided for each of the heating units, which are able to set the heating temperature independently of one another.

A gate driver for the thyrister 70 consists of a capacitor 75, a diode 76, and resister 77, 78 to enable zero-voltage ignition of the thyrister 70. A resistor 79 and a diode 80 are provided for thyrister gate protecting purposes.

The ultrasonic type atomizer (including the blower 12) forms a series circuit together with a "mist" switch 81, which series circuit is inserted in parallel with the heater element series circuit. A variable resistor 82 is able to control the amount of the mist.

The primary winding of the transformer 83 is connected to the a.c. power supply 74 via the temperature fuse 73 and the power switch 61, while the secondary winding thereof is connected to a rectifier circuit including a diode 84 and a capacitor 85 as a d.c. power supply. The d.c. power supply is connected to a temperature detector which contains the above described thermo-sensitive element or the negative characteristic thermistor 66, a temperature-adjustable variable resistor 86, a PNP type transistor 87, an NPN type transistor 88, and resistors 89, 90, 91. The temperature detector is coupled with the gate driver of the thyrister 70 via a photo-coupler 92 which provides electric isolation between the a.c. power supply 74 and the thermistor 66. The variable resistors 86 for the respective heater element circuits can be set at the same value.

The d.c. power supply is connected to a thermistor burn-out or failure detector containing a PNP type transistor 93, an NPN type transistor 94, resistors 95, 96, 97, a relay 98 and diodes 99, 100. The transistor 93 has the base thereof connected via the diode 99 to the base of the transistor 87. With such an arrangement, the base potential of the transistor 87 is transmitted to the base of the transistor 93 immediately after the thermistor 66 has been broken. The threshold level of the thermistor failure detector is selected higher than that of the temperature detector. The relay 97 has a contact 101 connected in series with the temperature fuse 73. The relay 98 closes the contact 101 when conducting and opens the same when non-conducting.

It will be noted that the temperature fuse 73 is disposed to response to the temperature within the head supporting helmet 35.

If it is desired to wave the hair, the patron's hairs are first wound about the curler rods 67 and then uniformly painted with a weaken waving agent. Thereafter, the respective ones of the thermistors 66 are attached to the curler rods 67 positioned about the central portions of the different hairline areas a through e. The patron card 68 is put on the controller 60 so that the heating temperatures and the heating period for the hairline areas a through e are selected by depression of the corresponding push-button switches.

After confirming the amount of water within the replenish tank 28 the "mist" switch 81 is closed so that the heater elements 50 and the atomizer start their functions because the timer contact 72 and the relay contact 101 are both closed.

Since the hair temperature is low and the resistance of the thermistor 66 is high at the initial stage of the heating action, the function of a d.c. bridge circuit including the thermistor 66, the variable 86 and the resistors 89, 90 is to place the transistor 87 into the off state and the next succeeding transistor 88 into the off state. Accordingly, no current flows through the photo-coupler 92 wherein a photo-transistor is in the off state. The charging current from the capacitor 75 is charged in response to the closing of the power switch 61 and enters into the gate of the thyrister 70, thereby turning the thyrister 70 on. As a result, the heater element 50 becomes conducting to start the heating of the hair.

If the temperature of the hair heated through the heater element 50 reaches the preset temperature, the thermistor 66 shows a reduction in the resistance thereof so that the transitors 87 and 88 are turned on through the action of the d.c. bridge circuit. Then, input current flows through the photo-coupler 92 and the light emitting diode within the photo-coupler 92 emits light and simultaneously the photo-transistor is turned on in response to that light. Discharging current for the capacitor 75 flows through the photo-transistor and not the gate of the thyrister 70. As a result, the thyrister 70 is non-conducting and the heater element 50 also is non-conducting, thus stopping the heating of the hair.

If the hair temperature is below the preset temperature, the resistance of the thermistor 66 is increased to turn on the thyrister 70, conducting the heater element 50 again to restart heating of the hair. Current supply to the heater element 50 is repeated in this manner, keeping the temperature of the hair at the preset temperature. This heating action is continued until the preset period has transpired.

Once the preset period has transpired, the timer contact 72 is opened in the conventional manner so that the heater element 50 is no longer supplied with current. Therefore, the heating action of the heater element 50 is terminated. The remaining heater elements 50 are controlled in the same manner. On the other hand, the moisture-laden mist is generated within the helmet 35 at room temperature while the heating action of the heater elements 50 is being carried out. Air introduced via the perforations 11 by the blower 12 traverses the body 5 and reaches the cutout 24 in the lid 17. After passing the cutout 24, air is guided into the water reservoir 16 via the cutout 25 by the replenish tank 28. Air within the reservoir 16 together with the mist generated at room temperature enters into the cylindrical guide 26 such that moisture-laden air mist mixture is distributed throughout the helmet 35 through the use of the obstacle 43 as it is ejected from the nozzle 44 via the connection hose 27 and the conduit 42. This mist imparts moisture to the hair, thus preventing the waving agent from being dried out while the heater elements 50 are activated. Accordingly, the waving agent can react satisfactorily on the hair. Used air is discharged from the outlets 53 via the perforations 54. The mist will remain as dew on the inner wall of the inner shell 37 and the protect net 52, etc. Droplets on the discs 38, 45 are guided to the drain exit 39 by the rising wall 49 without falling onto the floor or patron's clothings. An appropriate hose can be connected to the drain exit 39.

As stated above, the hair is waved or curled while the hair is being heated and moisturized by the moisture-laden air mist. The heating temperature and heating period are adequately determined by the type and intensity of waving agents used, the hair nature of patrons and other factors are taken into consideration. Waving agents can react satisfactorily on the hair to confer durable hair waves without drying out. When the patron desires the same hair style, the same patron card 68 is employed and the corresponding inputs are applied to the controller 60. In the case where it is desired to partially vary the degree of hair waving because of the hair style desired, the heating periods are altered for the different areas a through e, modifying the heated conditions of the different hairline areas. Alarm means can be provided to provide an alarm signal when terminating the action.

In the event that any one of the thermistors 66 fails to detect the temperature, the thermistor failure detector senses such failure and then ceases supplying all of the heater elements 50 and the ultrasonic type atomizer with power. In other words, when any one of the thermistors 60 is burned out, the voltage there across is increased so that the base potential of the transistor 87 is transferred via the diode 99 to the base of the transistor 93, thereby turning the transistors 93, 94 off. Under these circumstances no current flows through the relay 98 and the relay contact 101 is returned to the opened position, suppressing the functions of the heater elements and the ultrasonic atomizer.

The above described hair waving appliance can serve also as a steamer. Water is employed with the atomizer. After the heating temperature of the heater elements 50 is preselected at the maximum, the "mist" switch 81 is closed so that the mist sent to the inside of the helmet 35 is heated and vaporized by the heater elements 50. In this instance the thermistors 66 are placed out of the range of heating temperatures of the heater elements 50. The heater elements 50 are energized in succession.

If the blower 12 is controllable independently of the ultrasonic atomizer, hot air is available through the functions of both the blower 12 and the heater elements 50. At this time, the hair waving appliance serves as a conventional hair dryer. The temperature of hot air is optionally under the control of the controller 60 and the thermistors 66. In addition. two or more replenish tanks containing different kinds of liquid can be provided for different applications.

Figure 7:
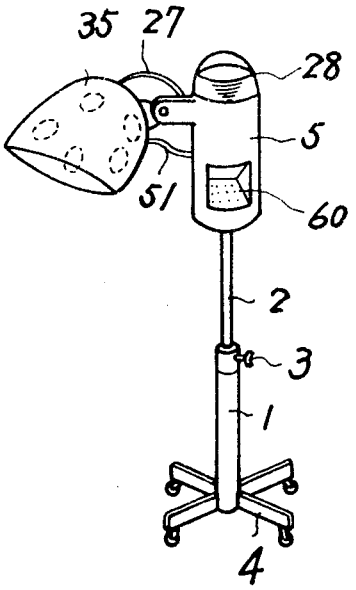
FIG. 7 is a perspective view of another preferred form of the present invention.

As noted with the above described hair waving appliance, the height and direction of the controller 60 is adjustable to facilitate operation without regard to the helmet 35 and the body 5. However, as obvious from FIG. 7 the controller 60 can be incorporated into the body 5. In addition, the thermistors 66 can be attached through the use of a hairline covering net.

Figure 8:
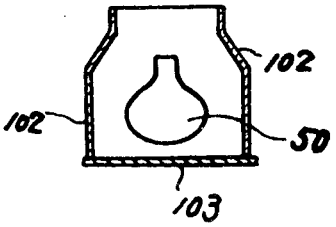
FIG. 8 is a cross-sectional view of installment of the heating means shown in FIG. 7.

FIG. 8 shows another preferred form of the present invention wherein an infrared lamp is employed as the heating means 50 to heat the hair due to the radiation heat therefrom. The infrared lamp 50 is surrounded by a reflector 102 and exposed to the inside of the head supporting helmet 35 through a heat-proof glass plate 103. With such an arrangement the hair is heated due to the radiation heat from the infrared lamp 50 while discharging convention heat.

Although the heating periods of the respective heater elements are determined independent in the above example, the heating temperatures of the respective heater elements can be determined independently while keeping the heating periods constant. Moreover, the heating period and heating temperature can be both determined independently. Anyway, the hair heated conditions can be controllable from area to area under the control of at least either of the heating period or the heating temperature.

While certain representative embodiments and details have been shown for the purpose of illustrating the invention, it will be apparent to those skilled in this art that various changes and modifications may be made without departing from the spirit or scope of the invention, and all such modifications as would be obvious to one skilled in the art are intended to be included within the scope of the following claims.

We claim:

1. A hair waving apparatus comprising:

a hood assembly adapted to be positioned around the head of a user;

a plurality of electrically operated heating means provided within said hood assembly for heating a plurality of different hairline areas of the head of a user; and a plurality of electrical controlling means individually operatively connected to each individual heating means to individually control both the heating temperature of each heating means and the interval of time each heating means is activated.

2. The hair waving apparatus as set forth in claim 1 wherein said atomizer means is of the ultrasonic type comprising an ultrasonic oscillator and an ultrasonic transducer.

3. The hair waving apparatus as set forth in claim 1 wherein said heating means comprise infrared heaters.

4. The hair waving apparatus as set forth in claim 1 wherein said heating means comprise infrared lamps from which the radiation heat serves to heat the different hairline area.

5. The hair waving apparatus as set forth in claim 2 wherein said atomizer means of the ultrasonic type further comprise a water reservoir connected to said ultrasonic transducer and a mist conduit connected to the inside of said hood assembly.

6. The hair waving apparatus as set forth in claim 5 wherein disabling means are operatively connected to said ultrasonic oscillator and said ultrasonic transducer for disabling said ultrasonic oscillator and said ultrasonic transducer in the absence of water in said water reservoir.

7. The hair waving apparatus as set forth in claim 1 wherein said hood assembly is made with a double walled construction comprising a pair of shells, the moisture-laden air mist being ejected between a cavity of said shells.

8. A hair waving apparatus comprising:

a hood assembly;

a plurality of individually controllable heating means provided within said hood assembly for heating different hairline areas of the head of a patron;

a plurality of driving means provided for said plurality of the individually controllable heating means, each of said driving means including a timer and thyrister in series with said individual heating means, said thyrister having a gate ignition circuit responsive to the output of a thermistor positioned to sense the temperature of the heated hair;

ultrasonic atomizer means provided with said hood assembly for generating moisture-laden air mist at room temperature, imparting moisture to the hair being heated by said heating means; and recording means for recording user information to ensure consistent repeated use of said hair waving apparatus, said recording means comprising a card with openings which operatively mate with selection buttons for individually controlling said heating means and said driving means, said card including operational indicia thereon.

9. A hair waving apparatus comprising:

a hood assembly;

a plurality of individually controllable heating means provided within said hood assembly for heating different hairline areas of the head of a patron, said heating means comprising infrared lamps for providing radiation heat;

a plurality of driving means provided for said plurality of the individually controllable heating means, each of said driving means including a timer and thyrister in series with said individual heating means, said thyrister having a gate ignition circuit responsive to the output of a thermistor positioned to sense the temperature of the heated hair; and ultrasonic atomizer means provided with said hood assembly for generating moisture-laden air mist at room temperature, imparting moisture to the hair being heated by said heating means.

10. The hair waving apparatus as set forth in claim 9 wherein a photo-coupler is provided between said gate ignition circuit of said thyrister and said thermistor for isolation purposes.

11. The hair waving apparatus as set for in claim 9 further comprising a thermistor failure protector means operatively connected for suppressing power supplied to said heating means and said ultrasonic atomizer means when said thermistor fails to sense the temperature.

12. The hair waving apparatus as set forth in claim 9 wherein the number of said individually controllable heating means is three (3) through seven (7).

13. A hair waving apparatus according to claim 1, and further including an atomizer means communicating with said hood assembly for generating moisture-laden air mist at room temperature, imparting moisture to the hair heated by said heating means.

14. A hair waving apparatus according to claim 13, and further including a protective means for protecting the heating means from the mist produced by said atomizer means.

15. A hair waving apparatus according to claim 1, wherein said heating means are arranged to heat three through seven divisions of the overall hairline area separately from one another.

16. A hair waving apparatus according to claim 1, and further including means for recording user information to ensure consistent repeated use of said hair waving apparatus.

17. A hair waving apparatus comprising:

a hood assembly adapted to be positioned around the head of a user;

a plurality of electrically operated heating means provided within said hood assembly for heating a plurality of different hairline areas of the head of a user;

a plurality of electrical controlling means individually operatively connected to each individual heating means to individually control both the heating temperature of each heating means and the interval of time each heating means is activated; and an atomizer means communicating with said hood assembly for generating moisture-laden air mist at room temperature, imparting moisture to the hair heated by said heating means.

18. A hair waving apparatus according to claim 17, and further including a protective means for protecting the heating means from the mist produced by said atomizer means.

19. A hair waving apparatus according to claim 17, wherein said heating means are arranged to heat three through seven divisions of the overall hairline area separately from one another.

20. A hair waving apparatus according to claim 17, and further including means for recording user information to ensure consistent repeated use of said hair waving apparatus.

21. A hair waving apparatus according to claim 17, wherein said heating means comprise infrared heaters.

22. A hair waving apparatus according to claim 17, wherein said heating means comprise infrared lamps from which the radiation heat serves to heat the different hairline area.

23. A hair waving apparatus according to claim 17, wherein said atomizer means is of the ultrasonic type and further comprising a water reservoir connected to an ultrasonic transducer and a mist conduit connected to the inside of said hood assembly.

24. A hair waving apparatus according to claim 23, wherein disabling means are operatively connected to said ultrasonic oscillator and said ultrasonic transducer for disabling said ultrasonic oscillator and said ultrasonic transducer in the absence of water in said water reservoir.

25. A hair waving apparatus according to claim 17, wherein said hood assembly is made with a double walled construction comprising a pair of shells, the moisture-laden air mist being ejected between a cavity defined by said shells.

26. A hair waving apparatus comprising:

a hood assembly adapted to be positioned around the head of a user;

a plurality of electrically operated heating means provided within said hood assembly for heating a plurality of different hairline areas of the head of a user; and a plurality of electrical controlling means individually operatively connected to each individual heating means to individually control the heating temperature of each heating means.

27. A hair waving apparatus according to claim 26, and further including a plurality of temperature sensing means operatively connected to said plurality of controlling means including a thermistor positioned to sense the temperature of the heated hair.

28. A hair waving apparatus according to claim 26, and further including an atomizer means communicating with said hood assembly for generating moisture-laden air mist at room temperature, imparting moisture to the hair heated by said heating means.

29. A hair waving apparatus according to claim 28, and further including a protective means for protecting the heating means from the mist produced by said atomizer means.

30. A hair waving apparatus according to claim 26, wherein said heating means are arranged to heat three through seven divisions of the overall hairline area separately from one another.

31. A hair waving apparatus according to claim 26, and further including means for recording user information to ensure consistent repeated use of said hair waving apparatus.

32. A hair waving apparatus according to claim 28, wherein said atomizer means are of the ultrasonic type comprising an ultrasonic oscillator and an ultrasonic transducer.

33. A hair waving apparatus according to claim 26, wherein said heating means comprise infrared heaters.

34. A hair waving apparatus according to claim 26, wherein said heating means comprise infrared lamps from which the radiation heat serves to heat the different hairline area.

35. A hair waving apparatus according to claim 32, wherein said atomizer means of the ultrasonic type further comprise a water reservoir connected to said ultrasonic transducer and a mist conduit connected to the inside of said hood assembly.

36. A hair waving apparatus according to claim 35, wherein disabling means are operatively connected to said ultrasonic oscillator and said ultrasonic transducer for disabling said ultrasonic oscillator and said ultrasonic transducer in the absence of water in said water reservoir.

37. A hair waving apparatus according to claim 26, wherein said hood assembly is made with a double walled construction comprising a pair of shells, the moisture-laden air mist being ejected between a cavity defined by said shells.

* * * * *